US005918822A

United States Patent [19]

Sternby

[11] Patent Number: 5,918,822

[45] Date of Patent: Jul. 6, 1999

[54] CHANNELED PULP ROTOR

[76] Inventor: Arthur J. Sternby, 450 Williams St., Pittsfield, Mass. 01201

[21] Appl. No.: 09/013,088

[22] Filed: Jan. 26, 1998

[51] Int. Cl.[6] ..... B02B 1/00

[52] U.S. Cl. ..... 241/46.17; 241/46.11; 241/292.1; 241/297

[58] Field of Search ..... 241/261.2, 261.3, 241/296, 297, 46.17, 46.11, 292.1

[56] References Cited

U.S. PATENT DOCUMENTS

| | | | |
|---|---|---|---|
| Re. 5,943 | 6/1874 | Belknap | 241/261.2 |
| 605,452 | 6/1898 | Rose | 241/261.3 |
| 777,410 | 12/1904 | Gaisser | 241/261.3 |
| 2,183,114 | 12/1939 | Bonapace | 241/89.4 |
| 2,858,990 | 11/1958 | Honeyman | 241/261.1 |
| 3,774,853 | 11/1973 | Seifert | 241/46.11 |
| 3,843,063 | 10/1974 | Honeyman | 241/46.11 |
| 3,889,885 | 6/1975 | Couture | 241/46.11 |
| 3,942,730 | 3/1976 | Coucher | 241/248 |
| 5,054,698 | 10/1991 | Schnell | 241/82.6 |
| 5,085,735 | 2/1992 | Nilsson | 162/26 |
| 5,112,443 | 5/1992 | Virving et al. | 162/23 |
| 5,597,127 | 1/1997 | Brown | 241/188.2 |
| 5,632,596 | 5/1997 | Ross | 415/83 |

FOREIGN PATENT DOCUMENTS

| | | | |
|---|---|---|---|
| 3803-619 | 8/1988 | Germany | 241/261.2 |

*Primary Examiner*—Joseph J. Hail, III
*Assistant Examiner*—Susan R. Kingsbury
*Attorney, Agent, or Firm*—Malcolm J. Chisholm, Jr.

[57] ABSTRACT

A channeled pulp rotor for use in a generally cylindrical or tub shaped pulper apparatus to make a slurry out of a mixture of solid and liquid materials for such things as paper making includes a rotor hub having at least one vane extending radially from a central axis of rotation of the rotor hub. The vane defines an impact surface between opposed top and bottom surfaces for impacting the solid materials upon rotation of the rotor and the impact surface defines a feed channel. The bottom surface defines a defibrating channel continuous with the feed channel so that materials flowing along or positioned in front of the rotating impact surface flow into the feed channel and continue from the feed channel to flow into the defibrating channel. In alternative embodiments, the feed channel and defibrating channels are eccentric to the axis of rotation of the rotor so that entries of the feed channel and defibrating channel are closer to the axis of rotation than exits of the channels. Centrifugal forces generated by rotation of the rotor act on the solid materials to force them through the feed and defibrating channels where they are sheared by cutting edges of a non-rotating plate adjacent the defibrating channel as the vanes rotate with the rotor hub.

20 Claims, 5 Drawing Sheets

CHANNELED PULP ROTOR

BACKGROUND OF THE INVENTION

The present invention relates to pulping apparatus for making a slurry out of a solid and liquid mixture for such things as paper making, and especially relates to pulp rotors that spin to mix solids and liquids into a slurry.

It is well known in the paper making industry to combine solid stock such as fibrous wood materials or recycled paper products with a liquid in a container generally known as a "pulper tub" having one or more pulp rotors. Such a rotor typically includes a plurality of vanes extending in a propeller-like fashion from a central axis of a rotor hub and the rotor spins to generate a circulatory motion in the mixture. Each vane includes a leading edge that serves, as the rotor spins, to mechanically shear fibrous components of the solid stock into smaller particles such as industrial paper making fibers. Hydraulic shear is also generated immediately above the rotor as it spins to further break up or defibrate the solid components. The rotor is typically placed adjacent a bed plate or an extraction plate in a well-known manner to assist in defibrating the solid materials.

In one form of such a pulping container or "pulper", the container is filled with one batch of solid and liquid materials, and then the rotor spins for a pre-determined period of time adjacent a bed plate having raised cutting edges to assist in defibrating the solid particles. The resulting slurry is then removed and processed into paper. In another well-known form of a "pulper", the liquid and solid materials are continuously fed into the container, and the rotor spins over an extraction plate defining extraction or feed-out holes that have circular cutting edges forming an entry to each feed hole that assist in breaking up the solid materials as the defibrated slurry continuously passes out of the feed-out holes to be further processed into paper.

Efforts to improve efficiencies of such rotors in "pulpers" have focused on decreasing power requirements to spin the rotor per unit of time to produce an acceptable slurry. For example, U.S. Pat. No. 3,889,885 issued on Jun. 17, 1975 to Couture and incorporated herein by reference discloses an improvement to pulper rotors wherein a plurality of fin-like "pumping vanes" are secured to and extend above upper surfaces of some vanes of a well known "Vokes" rotor to increase vortical circulation above the rotor. The increased circulation draws the liquid solid mixture more efficiently toward leading edges of the vanes, and in particular draws any solids suspended near or floating at a surface of the liquid down toward the rotor and corresponding bed or extraction plate. While such an improved vortical circulation decreases an overall rotating time period necessary to produce an acceptable slurry, the fin-like pumping vanes however also offer greater resistance to rotation of the vanes, and hence increase power requirements to rotate the vanes for the decreased rotating time period. Therefore the improvements shown in Couture and other known improved pulper rotors fail to decrease power requirements through any improvement in inherent mechanical defibrating capacities of the rotors.

Accordingly, it is the general object of the present invention to provide a channeled pulp rotor that overcomes deficiencies of the prior art.

It is a more specific object to provide a channeled pulp rotor that increases mechanical shear capacity of the rotor without significantly increasing power requirements to spin the rotor.

It is another specific object to provide a channeled pulp rotor that increases circulation of a slurry adjacent and above the rotor without significantly increasing power requirements to spin the rotor.

It is yet another object to provide a channeled pulp rotor that increases mechanical shear capacity of the rotor in a batch or continuous flow pulper.

These and other advantages and objects of the present invention will become more readily apparent when the following description is read in conjunction with the accompanying drawings.

SUMMARY OF THE INVENTION

A channeled pulp rotor is disclosed for use in a pulper apparatus that makes a slurry out of a mixture of solid and liquid materials for such things as paper making. In a particular embodiment the channeled pulp rotor includes a rotor hub having at least one vane extending radially from a central axis of rotation of the rotor hub. The vane defines an impact surface for impacting the solid materials upon rotation of the rotor and the impact surface defines a feed channel. The vane also defines a bottom surface secured to and extending away from the impact surface in a direction opposed to a direction of rotation of the rotor, and the bottom surface defines a defibrating channel continuous with the feed channel so that materials flowing along or positioned in front of the rotating impact surface flow into the feed channel and continue from the feed channel to flow into the defibrating channel.

In one alternative embodiment, the feed channel in the impact surface of the channeled pulp rotor is defined to be in slightly less than a vertical disposition relative to an axis perpendicular to a plane of rotation of the rotor wherein an entry of the feed channel positioned adjacent a top surface of the vane is closer to an axis of rotation of the rotor than an exit of the feed channel positioned adjacent the bottom surface of the vane. In another alternative embodiment, the defibrating channel in the bottom surface is defined to be in slightly less than a vertical disposition relative to an axis perpendicular to the axis of rotation of the rotor wherein an entry of the defibrating channel positioned adjacent the exit of the feed channel is closer to the axis of rotation of the rotor than an exit of the defibrating channel. In the alternative embodiments of the channeled pulper rotor, spinning of the rotor imparts a centrifugal force upon the mixture of solid and liquid materials that assists the materials in moving through the feed and defibrating channels.

In use of the channeled pulper rotor, the feed channels defined in the impact surfaces of vanes of the channeled pulper rotor serve to catch solid materials as the rotor spins. Some of the solid materials caught by the feed channels shear or break into smaller particles upon impact with the channels, and some portions of the solid materials remain within the feed channels and then flow through the feed channels and, without interruption, continue into the adjacent defibrating channels that are continuous with the feed channels. The solid materials then pass along the bottom surface of the vane as the vane continues to rotate with the rotor hub. The rotor is positioned to have its bottom surface adjacent a bed plate or an extraction plate so that cutting edges of the bed plate or cutting edges forming feed-out holes in the extraction plate cooperate with the defibrating channels passing over the plates to mechanically and hydraulically shear in a scissors-like manner the solid materials passing through the defibrating channels.

DETAILED DESCRIPTION OF THE PREFERRED EMBODIMENTS

Figure 1:
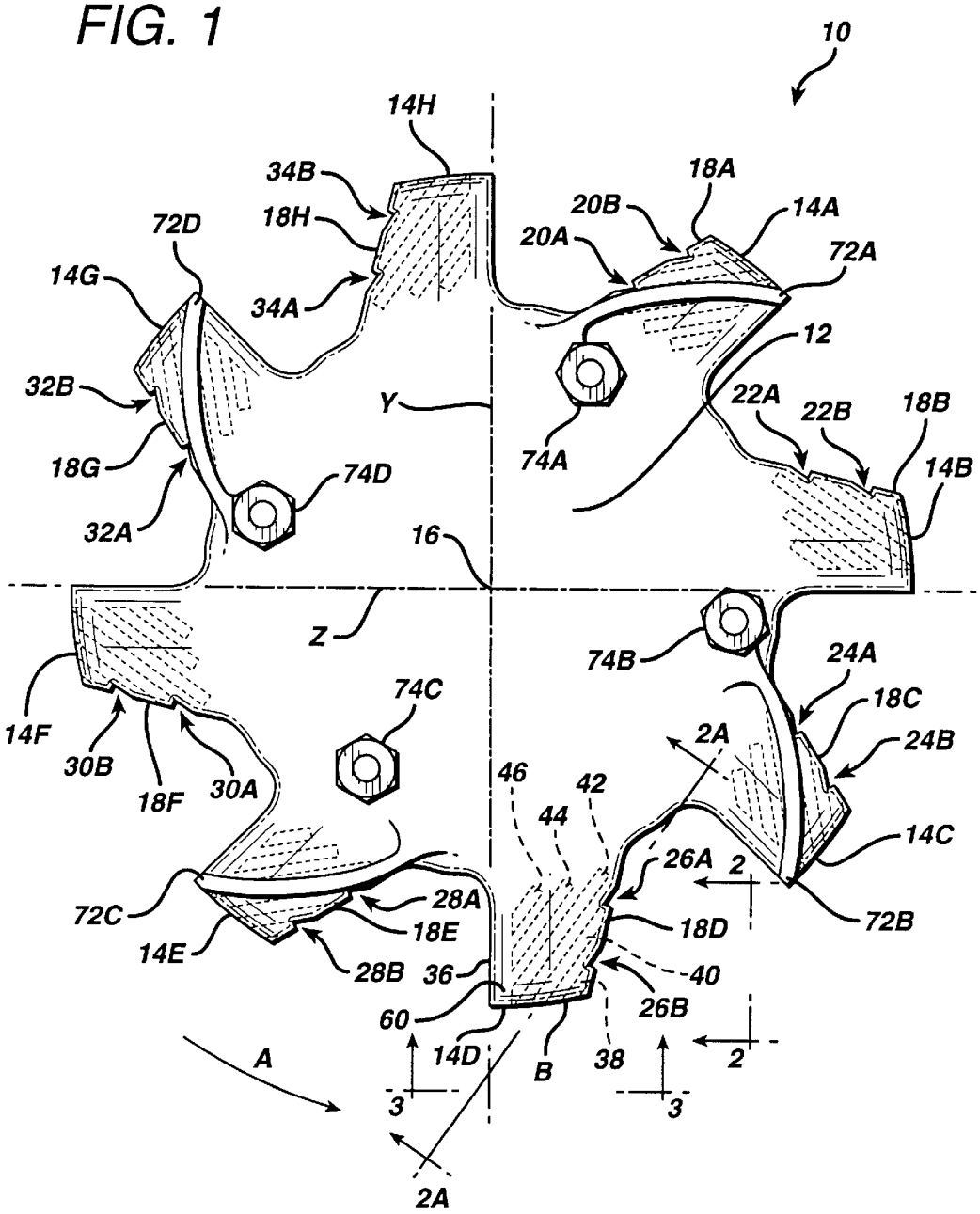
FIG. 1 is a top plan view of a channeled pulp rotor constructed in accordance with the present invention, showing feed channels defined in impact surfaces of vanes of the rotor.
Figure 6:
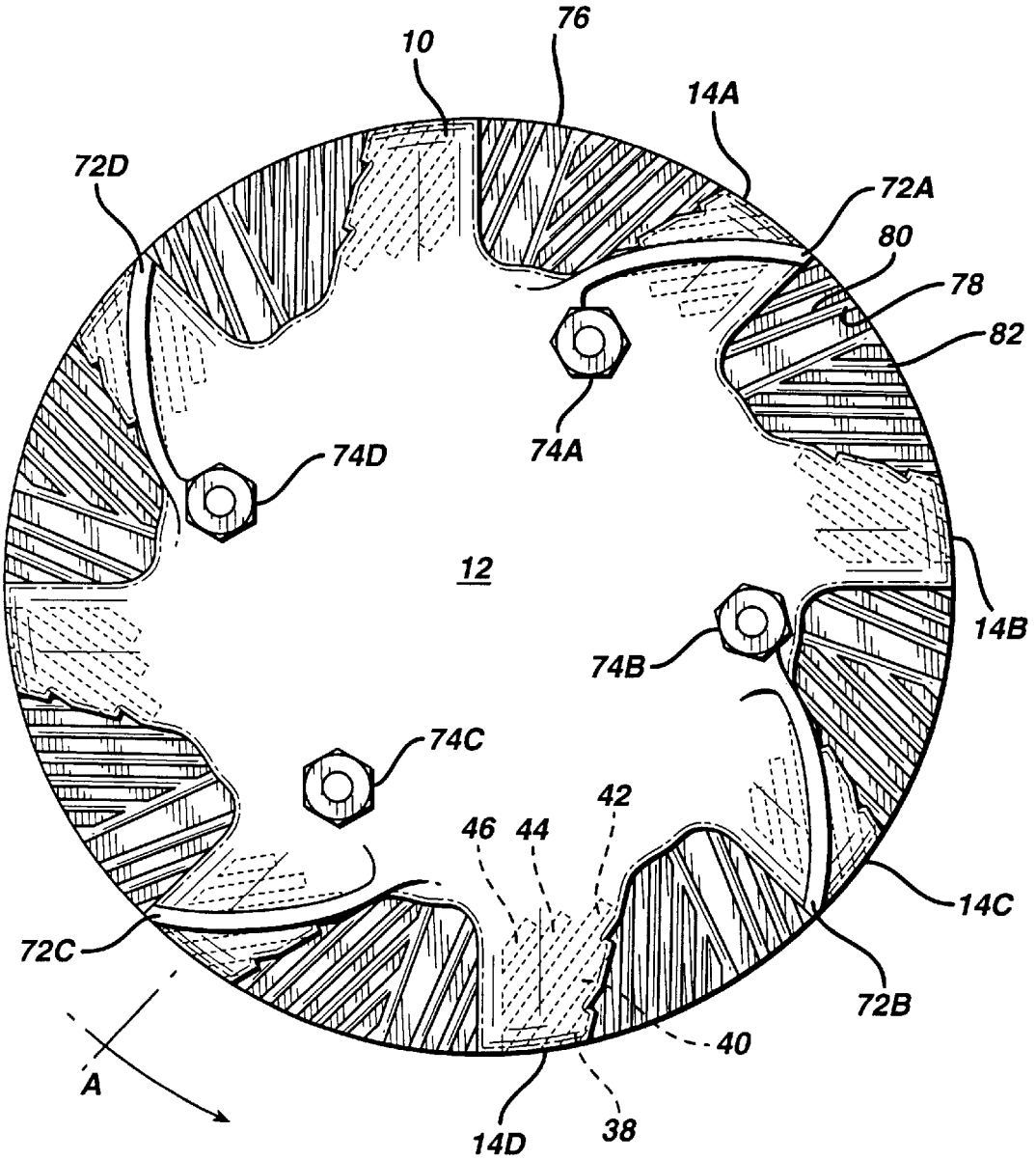
FIG. 6 is a plan view showing the channeled pulp rotor of FIG. 1 positioned on the bed plate of FIG. 4.

Referring to the drawings in detail, a channeled pulp rotor of the present invention is shown best in FIGS. 1 and 6, and is generally designated by the reference numeral 10. The channeled pulp rotor 10 is primarily for generating a slurry in a mixture of solid and liquid materials (not shown) as used in paper making. Such materials generally include pulp in sheet form, or recycled paper-making furnishes. As best shown in FIG. 1, the channeled pulp rotor 10 includes a rotor hub 12 having a plurality of vanes 14A, 14B, 14C, 14D, 14E, 14F, 14G, 14H extending radially from a central axis of rotation 16 of the rotor hub 12. Each vane defines an impact surface 18A, 18B, 18C, 18D, 18E, 18F, 18G, 18H for impacting solid materials in the mixture of solid and liquid materials, and each impact surface defines a plurality of feed channels 20A, 20B, 22A, 22B, 24A, 24B, 26A, 26B, 28A, 28B, 30A, 30B, 32A, 32B, 34A, 34B, (wherein reference numerals 20A, 20B refer to feed channels defined in the impact surface 18A of vane 14A, and reference numerals 22A, 22B refer to feed channels defined in the impact surface 18B of vane 14B, etc.).

Each vane also defines a bottom surface 36. (For convenience only the bottom surface 36 of the vane identified in FIG. 1 by reference numeral 14D is separately numbered in FIG. 1, and vane 14D is shown in more detail in FIGS. 2 and 3). As best seen in FIG. 1, the bottom surface 36 is secured to and extends away from the impact surface 18D in a direction opposed to a direction of rotation of the rotor hub 12, which direction of rotation is designated by a directional arrow labelled A in FIG. 1. The bottom surface 36 defines a plurality of defibrating channels, including a first defibrating channel 38, second defibrating channel 40 (shown in FIGS. 1, 2 and 2A), and third, fourth and fifth defibrating channels 42, 44, 46 (shown in hatched lines only in FIG. 1). For convenience, only the vane identified by the reference numeral 14D in FIG. 1 includes identification of five defibrating channels by specific reference numerals. However, it is understood that each of the remaining vanes 14A, 14B, 14C, 14E, 14F, 14G, 14H could also have a plurality of virtually identical defibrating channels on their corresponding bottom surfaces, as indicated by the hatched lines in those vanes in FIG. 1.

Figure 2:
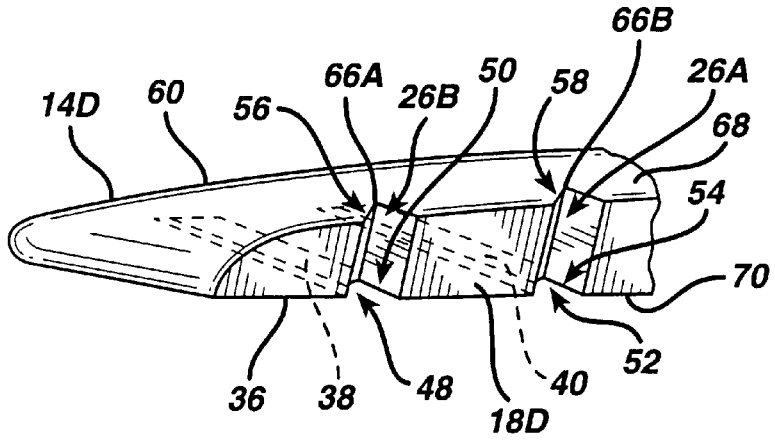
FIG. 2 is a fragmentary sectional view of a vane of the FIG. 1 channeled pulp rotor taken along line 2—2 of FIG. 1.
Figure 2A:
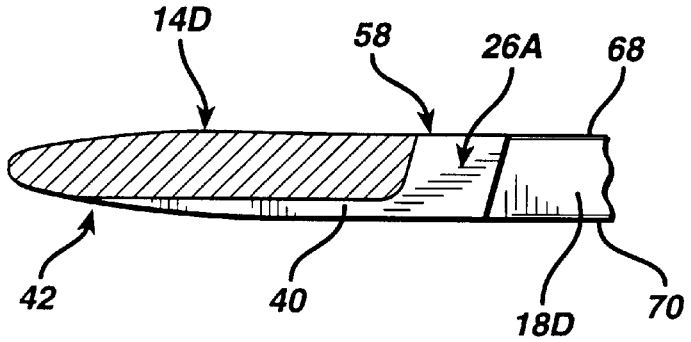
FIG. 2A is a fragmentary sectional view of a vane of the FIG. 1 channeled pulp rotor taken along line 2A—2A of FIG. 1.

As best seen in FIGS. 1, 2 and 2A, the first and second defibrating channels 38, 40 are continuous with corresponding first and second feed channels 26B, 26A, of vane 14*d*, while the third, fourth and fifth defibrating channels 42, 44, 46 are not continuous with any feed channels. By the phrase "continuous with", it is meant that the first defibrating channel 38 includes a first entry 48 that is adjacent a first feed channel exit 50 of feed channel 26B, and the second defibration channel 40 includes a second entry 52 that is adjacent a second feed channel exit 54 of feed channel 26A, so that materials flowing through the first or second feed channel exits 50, 54 may flow uninterrupted directly into the corresponding first or second defibrating channels 38, 40 without having to flow all the way to the bottom surface 36.

As best seen in FIG. 2, the first and second feed channels 26B, 26A of vane 14D may be defined to be in slightly less than a vertical disposition relative to an axis perpendicular to a plane of rotation of the vane 14D, wherein a first feed channel entry 56 and a second feed channel entry 58 of the first and second feed channels 26B, 26A are defined within a top surface 60 of vane 14D to be closer to the axis of rotation 16 of the rotor hub 12 than the first feed channel exit 50 and second feed channel exit 54 of first and second feed channels 26B, 26A. For convenience, such an offset disposition of feed channels in aimpact surfaces will be referred to as the feed channels being eccentric to the axis of rotation 16 of the channeled pulp rotor 10. It has been determined that, for defibrating solid stock material for making paper, an optimum range of eccentricity of the first and second feed channels 26B, 26A is between 45 to 85 degrees, meaning that an axis passing through the entry and exit of a feed channel extends at an angle of between 45 to 85 degrees from an axis perpendicular to the axis of rotation 16 of the rotor hub 12 wherein an entry of the feed channel is closer to the axis of rotation 16 than an exit of the feed channel.

Figure 3:
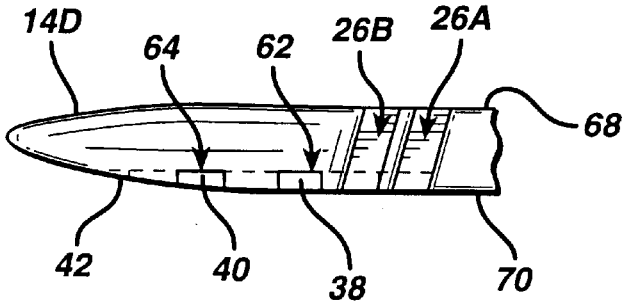
FIG. 3 is a fragmentary sectional view taken along line 3—3 of FIG. 1.

As best seen in FIG. 1, the first and second defibrating channels 38, 40 may also be defined to be in less than a vertical disposition relative to an axis perpendicular to the axis of rotation 16 of the rotor hub 12 and vane 14D, wherein the first and second entries 48, 52 of the first and second defibrating channels are closer to the axis of rotation 16 than a corresponding first defibrating channel exit 62 and a corresponding second defibrating channel exit 64 (shown best in FIG. 3). Again, for convenience, such an offset disposition of defibrating channels in bottom surfaces of channeled pulp rotor 10 vanes will be referred to as the defibrating channels being eccentric to the axis of rotation 16 of the channeled pulp rotor 10. For defibrating solid stock materials for making paper, it has been determined that an optimum range of eccentricity of the defibrating channels is between 5 and 50 degrees, meaning that an axis passing between an entry and exit of a defibrating channel extends at an angle of He between 5 and 50 degrees from an axis perpendicular to the axis of rotation 16 of the channeled pulp rotor 10, wherein the entry of the defibrating channel is closer to the axis of rotation 16 than an exit of the defibrating channel. For ease of understanding, two imaginary axes perpendicular to the axis of rotation 16 are shown in FIG. 1, and designated by reference letters Y and Z. As seen in FIGS. 1 and 2, the first and second feed channels 26B, 26A may be "V" shaped to enhance capture of fibrous materials during rotation of the rotor 10 and to facilitate continuous flow of the captured materials into the adjacent first and second defibrating channels 38, 40. Such "V" shaped feed channels are defined by only two planar walls and therefore include only one central corner 66A, 66B (shown in FIG. 2). In contrast, a three-walled, rectangular type of channel (not shown) would include two corners that could impede flow of fibrous materials, and serve to impede flow of such materials especially where the materials must flow from such a feed channel into a continuous defibrating channel.

It is pointed out that the impact surfaces as exemplified by impact surface 18D of vane 14D may be in a disposition that is slightly less than vertical relative to an axis perpendicular the plane of rotation of channeled pulp rotor 10, wherein a top leading edge 68 of vane 14D is forward of a bottom leading edge 70 of vane 14D, relative to the direction of rotation A of the vane 14D. For convenience, such an impact surface disposition will be referred to as a forwardly disposed impact surface. It has been determined that an optimum range of forward disposition of the impact surfaces is a range of between 5 and 15 degrees, meaning that an axis passing through the top and bottom leading edges 68, 70 of impact surface 18D extends at an angle of between 5 and 15 degrees from an axis perpendicular to the plane of rotation of the channeled pulp rotor 10, wherein the top leading edge 68 is forward of the bottom leading edge 70 of the vane 14D relative to the direction of rotation A of the rotor 10.

Also shown in FIG. 1 are a plurality of pumping vanes 72A, 72B, 72C, 72D secured respectively to vanes 14A, 14C, 14E, and 14G for enhancing vortical circulation of the mixture. A plurality of mounting bolts 74A, 74B, 74C, 74D are shown as well in the rotor hub 12 for securing the rotor 10 to a rotating means (not shown) for rotation of the channeled pulp rotor 10, such as a powered shaft.

Figure 4:
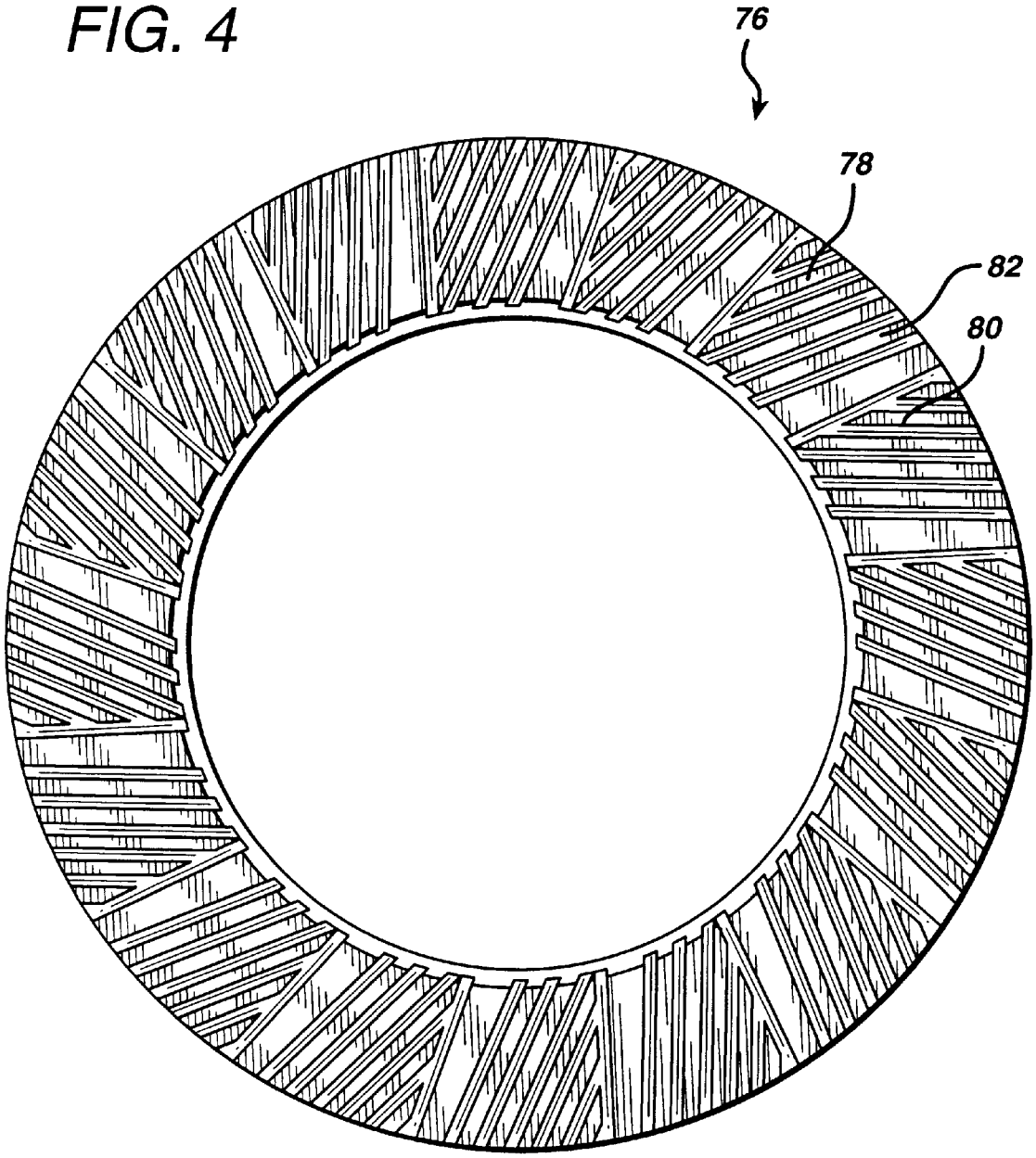
FIG. 4 is a top plan view of a bed plate used in combination with the channeled pulp rotor of the present invention.

The present invention includes usage of a channeled pulp rotor system for processing of flowable solid and liquid materials into a slurry that includes a channeled pulp rotor 10 disposed so that bottom surfaces 36 of vanes 14A, 14B, 14C, 14D, 14E, 14F, 14G, 14H are adjacent plates having cutting edges that cooperate with the defibrating channels 38, 40 to mechanically shear solid materials as the rotor 10 rotates relative to the plates. As shown in FIG. 6, such a channeled pulp rotor system could include a ring-shaped bed plate 76 is shown in FIG. 4 that includes a plurality of raised surfaces (shown in checkerboard shading in FIG. 4) such as a first raised surface 78. Each raised surface defines cutting edges such as first cutting edge 80 surrounding the surface 78 and the raised surfaces define a plurality of slots between the surfaces in a well-known manner. As shown in FIG. 6, during operation of the channeled pulp rotor 10, the vanes 14A, 14B, 14C, 14D, 14E, 14F, 14G, 14H overlie the raised surfaces and slots so that the cutting edges cooperate with the vanes to mechanically shear solid materials into a slurry.

The raised surfaces may define a first scissors slot 82 which is in a disposition relative to the first and second defibrating channels 38, 40 wherein a longitudinal axis of the first scissors slot 82 is not parallel to a longitudinal or flow axis of the first or second defibrating channels. For convenience, such a disposition of a scissors slot relative to a defibrating channel will be referred to as the scissors slot 82 being in a scissors-like disposition to a defibrating channel. It has been determined that optimum mechanical shearing between defibrating channels and a scissors slot is achieved when the scissors-like disposition between a defibrating channel and a scissors slot is between 2 and 20 degrees, meaning that an axis parallel to a longitudinal axis of the scissors slot 82 passes through an axis parallel to a longitudinal or flow axis of the first or second defibrating channels 38, 40 at an angle of between 2 and 20 degrees. Tests to determine such an optimal disposition established that no angle or a parallel alignment between a scissors slot and a defibrating channel resulted in virtually no mechanical shearing so that a "chatter" was created between the vanes and bed plate 76 as fibrous materials accumulated at the defibrating channels and along the cutting edges 80 of the bed plate. Further testing established that the optimum range of scissors-like disposition between the first and second defibrating channels 38, 40 and scissors slots 82 of the bed plate 76 dramatically enhanced mechanical shearing of fibrous materials between the defibrating channels and the cutting edges 80 defining the scissors slots 82 thereby substantially reducing operating time necessary to produce an acceptable slurry. An optimum angle between an axis parallel to a scissors slot 82 and axis parallel to a longitudinal axis of the first or second defibrating channel 38, 40 is about 5 degrees.

Figure 5:
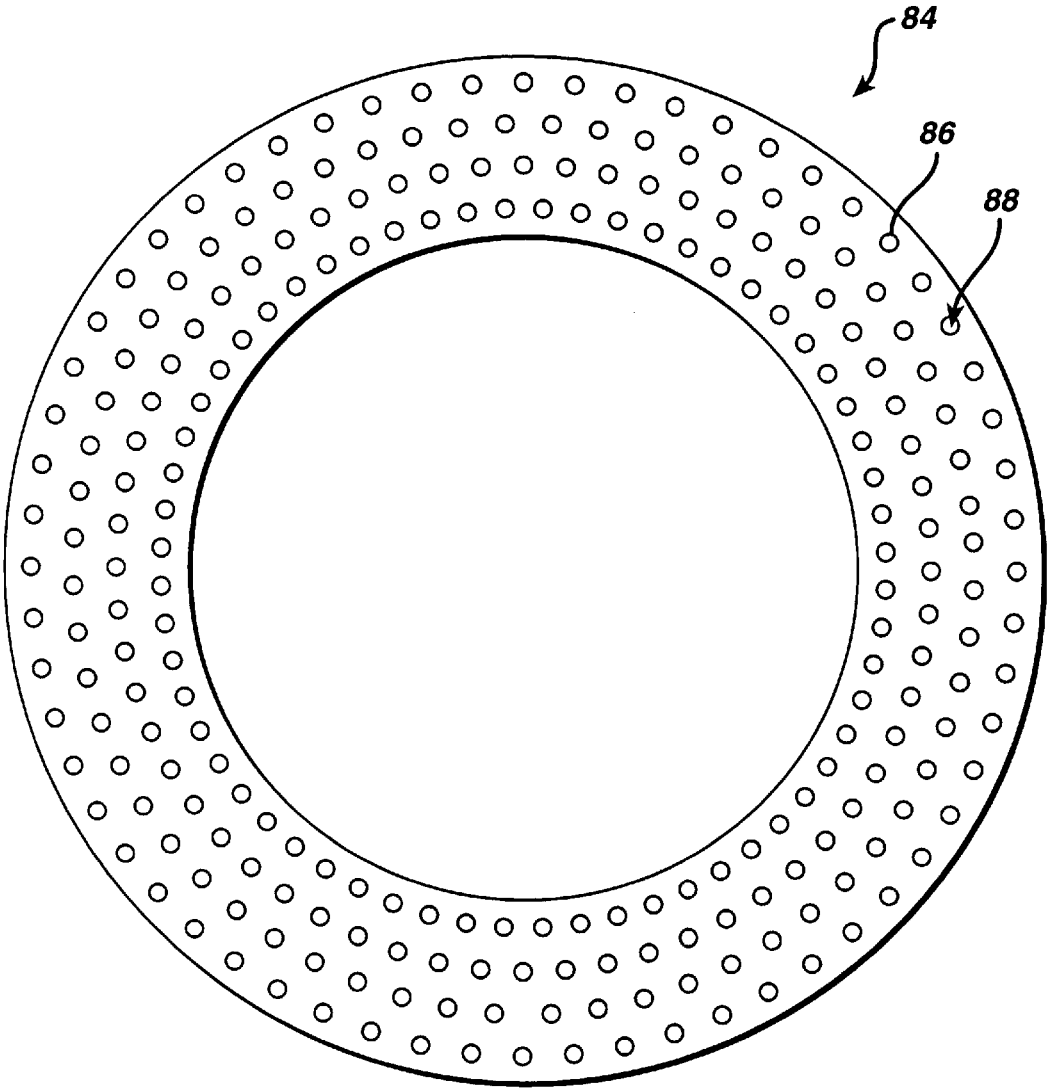
FIG. 5 is top plan view of an extraction plate used in combination with the channeled pulp rotor of the present invention.

The channeled pulp rotor system may alternatively include an extraction plate 84 is shown in FIG. 5, that defines a plurality of circular cutting edges such as circular cutting edges 86 that form feed-out holes such as feed-out holes 88 in a well-known manner. The bed plate 76 of FIG. 4 is typically used for processing a single batch of liquid and solid materials into a slurry, wherein after rotation of the channeled pulp rotor 10 for a specific period of time, the rotor 10 stops rotating, and the slurry is poured out of a container (not shown) housing the rotor 10 and bed plate 76. In contrast to use of the bed plate 76, use of the extraction plate 84 enables a processed slurry to pass through the feed-out holes 88 including solid particles of acceptable size after treatment by the channeled pulp rotor 10. The rotor 10 is disposed adjacent the extraction plate 84 so that the vanes 14A, 14B, 14C, 14D, 14E, 14F, 14G, 14H pass over the circular cutting edges 82 of the plate 84 that assist in shearing fibrous solid materials in cooperation with the first and second defibrating channels 38, 40. As seen in FIG. 1 and described above the first and second defibrating channels 38, 40 may be eccentric to the axis of rotation 16 of the rotor 10. It has been determined that when the first and second defibrating channels 38, 40 are disposed eccentrically so that they are not perpendicular relative to an axis perpendicular to the axis of rotation 16 of the rotor 10, the defibrating channels pass over the circular cutting edges 86 of the feed-out holes 88 in a slicing fashion because longitudinal axes of the defibrating channels in such an eccentric disposition necessarily pass over the feed-out holes 88 in a direction that cannot be parallel to the rotational direction A of the vane 14D. Consequently, the defibrating channels 38, 40 never impact fibrous materials within the feed-out holes 88 in a chopping or axe-like motion, but instead slice through the fibrous materials, enhancing mechanical shearing capacity of the channeled pulp rotor 10 adjacent the extraction plate 84.

Use of an exemplary channeled pulp rotor 10 having feed channels eccentric to the axis of rotation of the rotor 10, having defibrating channels eccentric to the axis of rotation, and having vanes with forwardly disposed impact surfaces has dramatically reduced necessary time for processing a mixture of liquid and solid materials into an acceptable slurry with minimal increase in power requirements. It is argued that the performance enhancements of the channeled pulp rotor 10 results primarily for the following reasons. As the rotor hub 12 commences rotation in a mixture of liquid and fibrous solid materials such as recycled newspaper or corrugated cardboard, impact surfaces 18A, 18B, 18C, 18D, 18E, 18F, 18G, 18H of vanes 14A, 14B, 14C, 14D, 14E, 14F, 14G, 14H contact solid materials, and the impact surfaces even if forwardly disposed are generally perpendicular to a resistance force or inertia of the mixture and especially of the solid materials in the mixture. Consequently, the mixture and especially the solid materials exert a compressive force on materials caught within the feed channels 20A,B–34A,B. Therefore, once fibrous solid materials are caught within the feed channels it is very difficult for them to leave the feed channels in a direction opposed to the compressive forces of the solid materials within the mixture. Simultaneously, the mixture starts spinning in response to rotation of the rotor 10, and the liquid and solid materials throughout the mixture develop centrifugal forces tending to force especially the solid materials away from the axis of rotation 16 of the rotor 10. Because the feed channels are in an eccentric disposition relative to the axis of rotation 16, the solid materials caught in the feed channels tend to move away from the axis of rotation 16, but most of those materials cannot overcome the compressive forces impacting the feed channels during rotation of the rotor 10. Therefore, the solid materials in the feed channels tend to move toward exits of the channels, such as first and second feed channel exits 50, 54 (shown in FIG. 2). The compressive forces then force the solid materials directly into adjacent defibrating channel entries, such as first and second defibrating channel entries 48, 52 because the defibrating channels are continuous with the feed channels wherein no structural impediment interrupts flow of the fibrous solid materials from the feed channels into the defibrating channels.

Once the solid materials are in the defibrating channels however, they no longer directly face compressive forces of the same magnitude of the compressive forces impacting the feed channels. Centrifugal forces acting upon the solid materials within the defibrating channels however still tend to force those materials along and out of the eccentric defibrating channels, away from the axis of rotation 16 of the rotor 10. Additionally, because the defibrating channels are eccentrically disposed relative to the axis of rotation 16, longitudinal axes of the rotating defibrating channels are therefore not moving parallel to a circular motion of the rotating liquid component of the mixture, but instead are moving at least partially across that circular motion so that turbulence results between the defibrating channels and the moving liquid component of the mixture. Therefore, the turbulence together with the lower compressive forces and centrifugal forces act on the fibrous materials within the defibrating channels to quickly extract the fibrous materials out of the defibrating channels so that the fibrous materials are rapidly sheared by cutting edges of a bed or extraction plate adjacent the bottom surface that defines the defibrating channels. Because the fibrous materials are so quickly removed as they pass along the defibrating channels, more fibrous materials may readily pass continuously through the feed channels and into the defibrating channels to dramatically decrease necessary time to process the liquid and solid materials into an acceptable slurry.

While the present invention has been described and illustrated with respect to a particular embodiment of a channeled pulp rotor, it will be understood by those skilled in the art that the present invention is not limited to this particular example. For example, the feed channels are not limited to rectangular shapes, but instead may be cone-shaped having cross-sectional areas of feed channel entries being less than cross-sectional areas of the feed channel exits, and/or cross-sectional areas of the defibrating channel entries may be greater than cross-sectional areas of defibrating channel exits in order to force solid materials out of the defibrating channels. Another example of an embodiment of the invention includes a channeled pulp rotor system wherein the scissors slots of a plate define cross-sectional areas that inversely correspond to cross-sectional areas of adjacent defibrating channels to enhance transfer of solid materials into the scissors slots from the defibrating channels. Additionally, the channeled pulp rotor has been described in a working environment of generating a paper-making slurry, but the invention is appropriate for any other working environment where rotary processing of flowable solid materials to smaller particles is required. Accordingly, reference should be made to the attached claims rather than the foregoing specification to determine the scope of the invention.

What is claimed is:

1. A channeled pulp rotor for processing flowable solid materials, comprising:

a. a rotor hub;

b. at least one vane extending radially from a central axis of rotation of the rotor hub;

c. an impact surface for impacting the solid materials upon rotation of the vane defined between a top surface and an opposed bottom surface of the vane, the top and bottom surfaces extending away from the impact surface in a direction opposed to a direction of rotation of the rotor hub, the impact surface defining a feed channel, and the bottom surface defining a defibrating channel continuous with the feed channel, the defibrating channel having an entry adjacent an exit of the feed channel between the top and bottom surfaces so that solid materials flowing into the feed channel upon rotation of the vane flow continuously into the defibrating channel without having to flow to the bottom surface.

2. The channeled pulp rotor of claim 1, wherein the feed channel is eccentric to the central axis of rotation of the rotor hub so that the feed channel is in slightly less than a vertical disposition relative to an axis perpendicular to a plane of rotation of the vane, wherein a feed channel entry is closer to the central axis of rotation than the feed channel exit adjacent the bottom surface.

3. The channeled pulp rotor of claim 2, wherein the feed channel is disposed in a range of eccentricity between 45 to 85 degrees relative to an axis perpendicular to the central axis of rotation.

4. The channeled pulp rotor of claim 1, wherein the defibrating channel is eccentric to the central axis of rotation of the rotor hub so that the defibrating channel is in less than a vertical disposition relative to an axis perpendicular to the axis of rotation of the rotor hub, wherein a defibrating channel entry adjacent the impact surface is closer to the central axis of rotation than a defibrating channel exit.

5. The channeled pulp rotor of claim 4, wherein the defibrating channel is disposed in a range of eccentricity between 5 and 50 degrees relative to an axis perpendicular to the central axis of rotation.

6. The channeled pulp rotor of claim 1, wherein the impact surface is forwardly disposed between 5 and 15 degrees from an axis perpendicular to a plane of rotation of the rotor hub, wherein a top leading edge of the impact surface adjacent the top surface is forward of a bottom leading edge of the impact surface adjacent the bottom surface relative to a direction of rotation of the rotor hub.

7. The channeled pulp rotor of claim 1, wherein the feed channel is "V" shaped defined by two planar walls joined within the channel at one central corner.

8. A channeled pulp rotor for making a slurry out of a mixture of liquid and solid materials, comprising;

a. a rotor hub;

b. at least one vane extending radially from a central axis of rotation of the rotor hub;

c. an impact surface for impacting the solid materials upon rotation of the vane defined between a top surface and an opposed bottom surface of the vane, the top and bottom surfaces extending away from the impact surface in a direction opposed to a direction of rotation of the rotor hub, the impact surface defining a feed channel eccentric to the central axis of rotation of the rotor hub wherein a feed channel entry is closer to the axis of rotation than a feed channel exit adjacent the bottom surface, and the bottom surface defining a defibrating channel continuous with the feed channel, the defibrating channel having an entry adjacent the exit of the feed channel between the top and bottom surfaces so that solid materials flowing into the feed channel upon rotation of the vane flow continuously into the defibrating channel without having to flow to the bottom surface.

9. The channeled pulp rotor of claim 8, wherein the feed channel is disposed in a range of eccentricity between 45 to 85 degrees relative to an axis perpendicular to the central axis of rotation.

10. The channeled pulp rotor of claim 8, wherein the defibrating channel is eccentric to the central axis of rotation of the rotor hub so that a defibrating channel entry adjacent the impact surface is closer to the central axis of rotation than a defibrating channel exit.

11. The channeled pulp rotor of claim 10, wherein the defibrating channel is disposed in a range of eccentricity between 5 and 50 degrees relative to an axis perpendicular to the central axis of rotation.

12. The channeled pulp rotor of claim 11, wherein the impact surface is forwardly disposed between 5 and 15 degrees from an axis perpendicular to a plane of rotation of the rotor hub, wherein a top leading edge of the impact surface adjacent the top surface is forward of a bottom leading edge of the impact surface adjacent the bottom surface relative to a direction of rotation of the rotor hub.

13. The channeled pulp rotor of claim 12, wherein the feed channel is "V" shaped defined by two planar walls joined within the channel at one central corner.

14. A channeled pulp rotor system for processing a flowable solid and liquid materials into a slurry, comprising:

a. a rotor hub;

b. at least one vane extending radially from a central axis of rotation of the rotor hub;

c. an impact surface for impacting the solid materials upon rotation of the vane defined between a top surface and an opposed bottom surface of the vane, the top and bottom surfaces extending away from the impact surface in a direction opposed to a direction of rotation of the rotor hub, the impact surface defining a feed channel, and the bottom surface defining a defibrating channel continuous with the feed channel, the defibrating channel having an entry adjacent an exit of the feed channel between the top and bottom surfaces so that solid materials flowing into the feed channel upon rotation of the vane flow continuously into the defibrating channel without having to flow to the bottom surface; and, d. a plate having cutting edges positioned adjacent the bottom surface so that the cutting edges cooperate with the defibrating channel to shear solid materials between the plate and bottom surface as the vane rotates relative to the plate.

15. The channeled pulp rotor system of claim 14, wherein the feed channel is eccentric to the central axis of rotation of the rotor hub so that the feed channel is in slightly less than a vertical disposition relative to an axis perpendicular to a plane of rotation of the vane, wherein a feed channel entry is closer to the central axis of rotation than the feed channel exit adjacent the bottom surface.

16. The channeled pulp rotor system of claim 15, wherein the defibrating channel is eccentric to the central axis of rotation of the rotor hub so that a defibrating channel entry adjacent the impact surface is closer to the central axis of rotation than a defibrating channel exit.

17. The channeled pulp rotor system of claim 16, wherein the plate includes raised surfaces having cutting edges defining a scissors slot in a scissors-like disposition relative to the defibrating channel, wherein a longitudinal axis of the scissors slot passes through an axis parallel to a flow axis of the defibrating channel at an angle of between 2 and 45 degrees.

18. The channeled pulp rotor system of claim 17, wherein a longitudinal axis of the scissors slot passes through an axis parallel to a flow axis of the defibrating channel at an angle of about 5 degrees.

19. The channeled pulp rotor system of claim 18, wherein the defibrating channel is disposed in a range of eccentricity between 5 and 50 degrees relative to an axis perpendicular to the central axis of rotation.

20. The channeled pulp rotor system of claim 19, wherein the rotor includes a plurality of vanes and the impact surface of each vane is forwardly disposed between 5 and 15 degrees from an axis perpendicular to a plane of rotation of the rotor hub, wherein a top leading edge of the impact surface adjacent the top surface is forward of a bottom leading edge of the impact surface adjacent the bottom surface relative to a direction of rotation of the rotor hub.

* * * * *